US005743767A

United States Patent [19]

Londeck et al.

[11] Patent Number: 5,743,767

[45] Date of Patent: Apr. 28, 1998

[54] INSTRUMENT CLUSTER GAUGE CONNECTOR

[75] Inventors: Bernard Thomas Londeck, Waterford; Donald Frederick Wildfong, Flint, both of Mich.; Nickey Doyle Keen, Kokomo, Ind.

[73] Assignee: Delco Electronics Corporation, Kokomo, Ind.

[21] Appl. No.: 295,123

[22] Filed: Aug. 24, 1994

[51] Int. Cl.[6] ..... H01R 13/10

[52] U.S. Cl. ..... 439/682

[58] Field of Search ..... 439/682, 684, 439/567, 78, 83, 58, 874

[56] References Cited

U.S. PATENT DOCUMENTS 3,474,394 10/1969 Hammell et al. ..... 439/682
4,274,700 6/1981 Keglewitsch et al. ..... 439/682
4,359,258 11/1982 Palecek et al. ..... 439/682
4,556,274 12/1985 Olivera ..... 439/682
4,599,588 7/1986 Bell ..... 439/874
4,837,927 6/1989 Savage, Jr. ..... 439/682

*Primary Examiner*—Hien D. Vu
*Attorney, Agent, or Firm*—Jimmy L. Funke

[57] ABSTRACT

A connector bridges the gap between a gauge and a printed circuit on an instrument cluster case. The connector has a molded body having a base seated on the case and a crown adjacent the gauge. Apertures in the crown receive gauge terminals. Contacts molded in the body have annular heads with spring fingers in the apertures for contacting the terminals and elongated legs extending through the base to connect with the printed circuit.

12 Claims, 2 Drawing Sheets

INSTRUMENT CLUSTER GAUGE CONNECTOR

FIELD OF THE INVENTION

This invention relates to electrical connectors and in particular to connectors for gauges in vehicle instrument clusters.

BACKGROUND OF THE INVENTION

Instrument clusters for automotive displays generally include an instrument case having a printed circuit on its rear surface and a face plate at the front. The depth of the case or the distance between the front and the rear of the case is dependent on the space required for the largest instruments. A gauge for a speedometer or fuel level display may be small and as it is mounted near the face plate to drive a pointer, it may be a substantial distance from the rear of the case and the printed circuit. It is necessary to connect terminals of the gauge to the printed circuit which carries the energizing signals for the gauge.

Heretofore, each gauge has been coupled to the printed circuit by a plurality of separate conductive clips, one for each gauge terminal. Each clip is elongated and includes on one end a fastener to engage an aperture in the circuit board and which is soldered to a circuit path, and, on the other end a female connector for receiving a gauge terminal. Thus if the gauge had four terminals it was necessary to separately handle four clip for installation onto the circuit board, keeping them all properly aligned to receive the four terminals.

SUMMARY OF THE INVENTION

It is therefore an object of the invention to couple a gauge to an instrument cluster circuit board by a single connector.

An automotive instrument cluster has a rigid case having a rear wall and side walls, and a front face plate carrying display indicia. Printed circuit paths are carried on the outer surface of the rear wall. Alternatively, the rigid case forms side walls only and a hardboard printed circuit comprises a rear wall which is attached to the case. Gauges are mounted on the face plate to drive pointers to indicate fuel level, vehicle speed, engine speed, or some other vehicle parameter. Gauge terminals in the form of cylindrical pins extend from the gauge body toward the rear wall of the case. Where the case is deep to accommodate large instruments, small gauges mounted on the face plate are spaced from the rear wall and require a connector to bridge the space and couple the terminals to the circuit paths.

The connector has a plastic body long enough to reach from the rear wall to a plane very close to the gauge body with apertures to receive the gauge terminals. The body has a base for seating on the rear wall. Elongated contacts insert molded in the plastic body each have an annular head with inner spring fingers in an aperture to engage a terminal, and an elongated stem extending through the body, beyond the base and through a hole in the case. Each of the holes in the case are surrounded by a circuit path portion comprising a solder pad to join the contact stem to the circuit. The plastic body has a pair of integral resilient clips which protrude from the base and through larger holes in the case adjacent the solder pads to secure the connector to the case. By snapping the connector to the case with the contacts protruding through their respective holes, and then soldering the contacts to the solder pads, the connector is firmly mounted to the case. In the meantime, the gauge is assembled to the face plate and then the gauge terminals are plugged into the apertures to complete the assembly when the face plate is mounted on the case.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
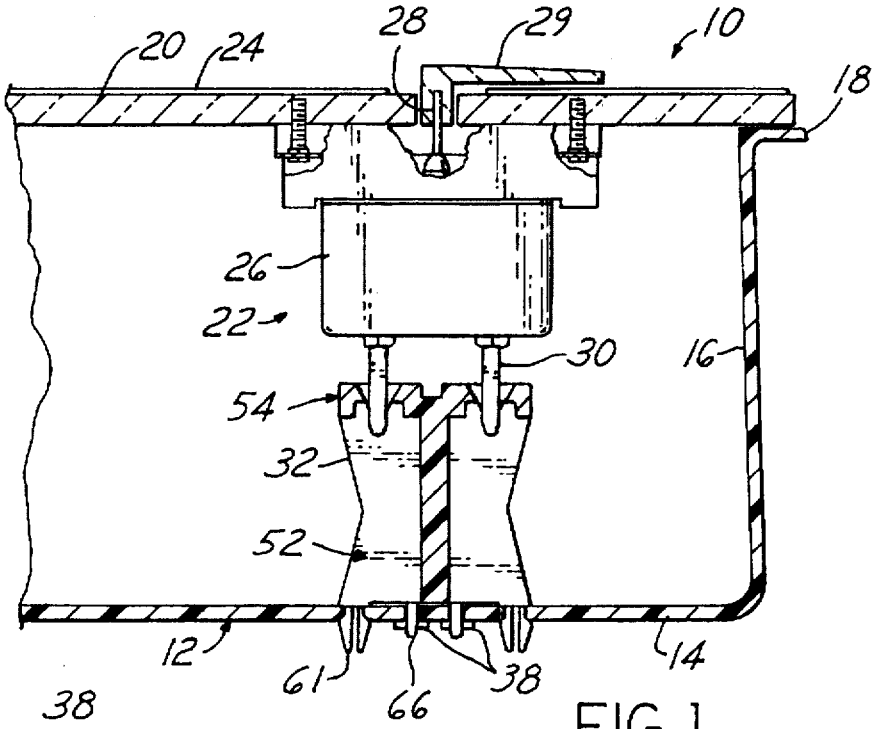
FIG. 1 is an Cross section of an instrument cluster containing a connector according to the invention.

Referring to FIG. 1, an instrument cluster 10 comprises a molded case 12 having a rear wall 14 and side walls 16 including a front flange 18, a face plate 20 mounted to the front flange 18 to define a cluster cavity, and instrumentation 22 within the cavity. The face plate usually comprises a translucent material used for display illumination purposes and carries a decorative front layer or graphics 24. In the partial cluster view of FIG. 1 the instrumentation comprises an air core gauge 26 driving a spindle 28 which supports and controls the position of a pointer 29. Cylindrical pins or terminals 30 extend from the back of the gauge 26. A connector 32 coupled to the terminals 30 extends from the gauge to the rear wall 14 of the case 12.

Figure 2:
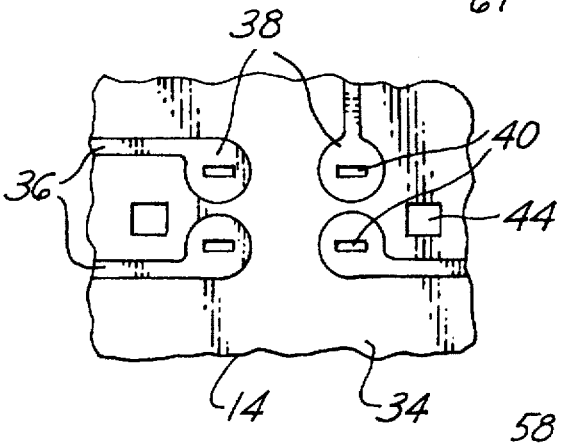
FIG. 2 is a rear view of a portion of the cluster showing circuit pathways.

As shown in FIG. 2, the outer surface 34 of the rear wall 14 carries a printed circuit having conductive paths 36 including solder pads 38. Slotted apertures 40 in the rear wall 14 register with the solder pads and receive connector contacts which are soldered to the pads 38. Square apertures 44 in the wall 14 adjacent the apertures 40 are provided to receive mounting clips of the connector.

Figure 3:
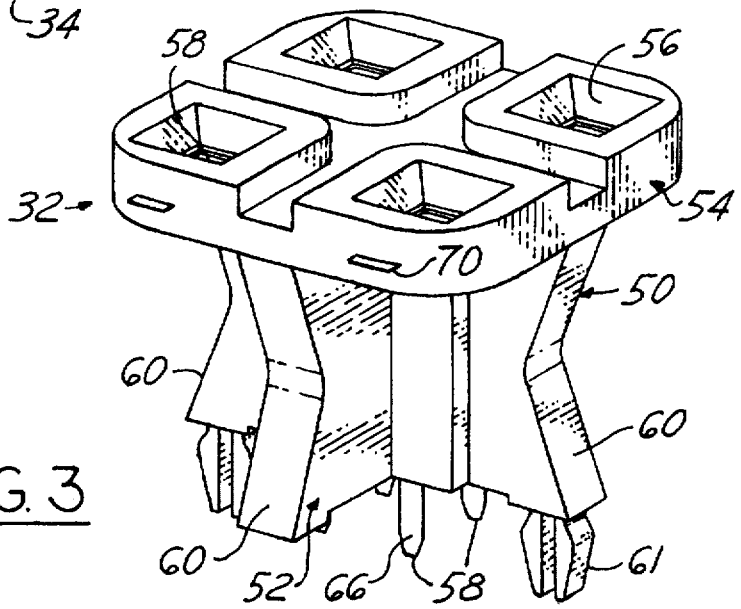
FIG. 3 is an isometric view of the connector of FIG. 1.
Figure 4:
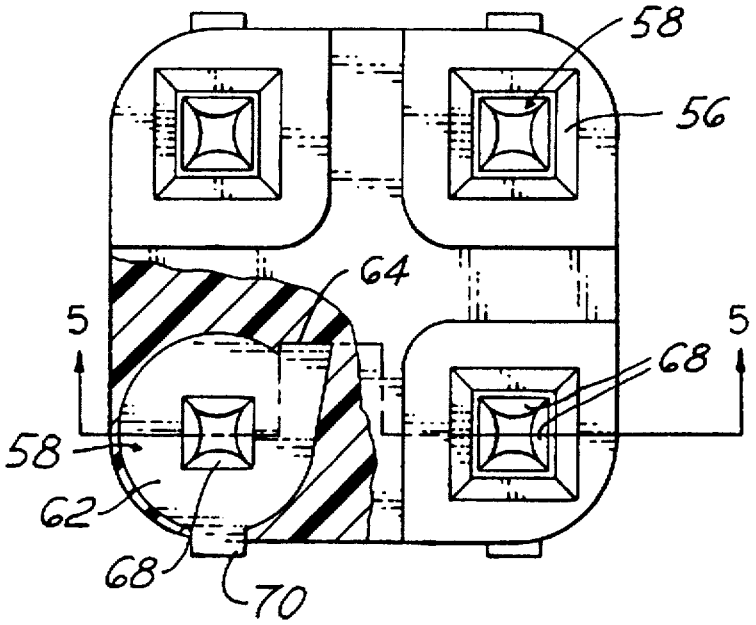
FIG. 4 is a partly broken away front view of the connector according to the invention.
Figure 5:
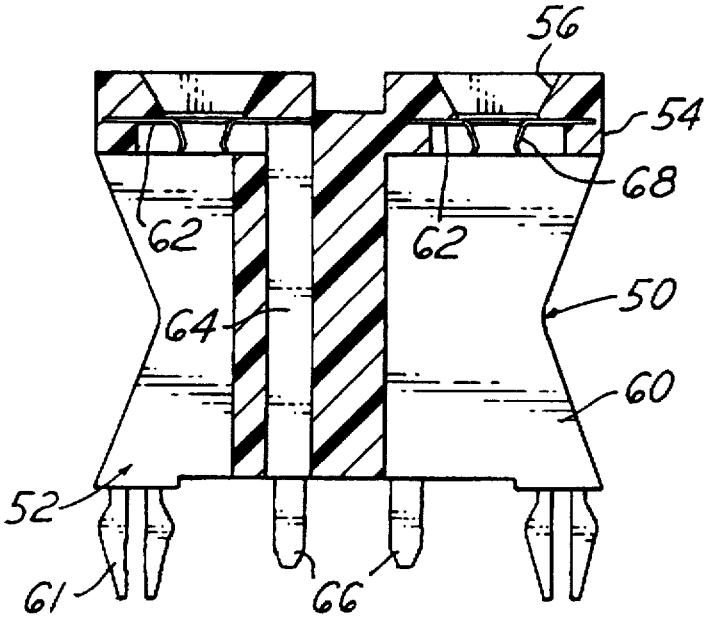
FIG. 5 is a cross section of the connector taken along line 5—5 of FIG. 4.

The connector 32, best shown in FIGS. 3–5, comprises a molded plastic body 50 having a base 52 for seating on the rear wall 14 and a crown 54 on the base 52 facing the back of the gauge 26, four apertures 56 in the crown 54 for receiving the gauge terminals 30, and contacts 58 insert molded in the body. The base 52 comprises four webs or ribs 60 in a cross shape. The crown 54 is generally square with rounded corners and overlies the regions between the webs 60; the apertures 56 are located in these regions so that terminal pins may extend beyond the crown and between the webs without interference. The apertures 56 are generally of square cross section and flare outwardly to facilitate pin insertion. Resilient retainer clips 61 extend from the base at the rear surface of two of the webs 60. These clips snap into the square apertures 44 in the wall 14 to mechanically support the connector 32.

Each contact 58 comprises phosphor bronze sheet material stamped to form an annular head 62 and an elongated leg 64 bent normal to the plane of the head. The head 62 surrounds an aperture 56 and its periphery is embedded in the plastic body. The elongated leg 64 extends through the body and beyond the base 52, terminating in a solder tab 66. The head is stamped to form four resilient fingers 68 extending inwardly and rearwardly to define an opening slightly smaller than the terminal 30 diameter, so that insertion of a terminal causes the fingers to flex back and securely grip the terminal to assure good electrical contact. Thus the annular head of each contact is a plug-in receptacle to slidably receive a gauge terminal. A lateral tab 70, which connects the contact to a frame during stamping and molding operations and is severed after molding, extends through the side of the crown.

To assemble the cluster, the connector 32 is attached to the rear wall 14 of the case by inserting the contact tabs 66 into through the slots 40 and snapping the clips 61 through the apertures 44. The tabs 66 are then soldered to the pads 38. The gauge 26 is mounted to the face plate 20, and the face plate is closed against the flange 18 of the case, causing the terminals 30 to be inserted into the apertures 56 of the connector 32.

In this description it has been assumed that the gauge has four terminal pins. Some gauges, however, have only two or three terminal pins. It is still useful to use the same connector even though one or two contacts will be unused. This standardization avoids proliferation of parts and so simplifies the manufacture and inventory of connectors. However, in some applications the spacing of the gauge from the rear wall of the case will be different from other applications; then connectors of different body lengths will be necessary.

The embodiments of the invention in which an exclusive property or privilege is claimed are defined as follows:

1. In an instrument cluster having a printed circuit board and a gauge having terminals spaced from the circuit board, a connector joining the gauge to the circuit board comprising:

a molded body for spanning between the gauge and the circuit board, the body having a base at one end thereof seating on the circuit board and a crown at the other end thereof facing the gauge, wherein the crown has a generally square shape;

a plurality of apertures in the crown for receiving the gauge terminals;

the base comprising a plurality of webs forming a cross shaped section;

the crown overlies the base and includes regions, wherein each of said regions is in between the webs, the apertures in the crown being in the regions; and electrical contacts positioned in said body with each of said contacts in each of said apertures for electrically contacting with one of said gauge terminals, said each of said electrical contacts having an elongated leg extending beyond the base for connection to the circuit board.

2. The invention as defined in claim 1 wherein a portion of each said contacts is embedded in the molded body to thereby accurately maintain a position of each of said contacts.

3. The invention as defined in wherein:

each of said apertures has a flared opening in the crown;

each of contacts has a head in the flared opening for gripping one of said gauge terminals; and the elongated leg of each of said contacts being partially embedded in the molded body.

4. The invention as defined in claim 1 wherein:

one of said apertures has a flared opening in the crown; and each of said contacts has a generally annular head in the flared opening for surrounding one of said gauge terminals and with inner resilient fingers for gripping the one of said gauge terminals.

5. The invention as defined in claim 1 including integral spring clips on the base for attachment to the circuit board, thereby securely fastening the connector to the circuit board.

6. The invention as defined in claim 1 wherein the printed circuit board defines mounting apertures; and the connector includes integral spring clips for protruding through the mounting apertures to engage the circuit board, thereby securely fastening the connector to the circuit board.

7. The invention as defined in claim 1 wherein each of said electrical contacts has a head within one of said apertures and the elongated leg of each of said electrical contacts extends through one of said webs adjacent the one of said apertures.

8. An instrument cluster including:

a printed circuit board;

a gauge separated from the circuit board by a space defined between the gauge and the circuit board, the gauge having terminals extending toward the circuit board;

a connector positioned in the space joining the gauge terminals to the circuit board;

the connector having a molded body with one end thereof being a crown having a generally square shape and the other end thereof including ribs in a cross shape and seated on the board, said molded body having regions between the ribs, four holes in said crown of the body overlying said regions, and four elongated electrical contacts in said molded body, with each of said elongated electrical contacts in each of said holes, the gauge terminals being connected by the elongated electrical contacts to the circuit board, thereby establishing an electrical connection for the gauge.

9. The invention as defined in claim 8 wherein:

the circuit board has apertures with each of said apertures receiving one of said contacts and conductive paths with one of said conductive paths extending to one of said apertures; and each of said contacts engages each of said apertures and is soldered to each of said conductive paths.

10. The invention as defined in claim 8 wherein:

the circuit board has apertures with one of said apertures receiving one of said contacts and solder pads with one of said solder pads surrounding one of said apertures; and each of said contacts engages each of said apertures and is soldered to each of said solder pads.

11. The invention as defined in claim 10 wherein each of said contacts forms a plug-in receptacle to slidably receive one of said gauge terminals.

12. The invention as defined in claim 8 including:

conductors positioned on the printed circuit board, one of said conductors for engaging one of said gauge terminals; and one end of each of said elongated electrical contacts positioned in each of said apertures in electrical contact with one of said gauge terminals and the other end of each of said elongated electrical contacts is soldered to each of said conductors positioned on the printed circuit board.

* * * * *